US007566059B2

(12) United States Patent
Bianco

(10) Patent No.: US 7,566,059 B2
(45) Date of Patent: Jul. 28, 2009

(54) TABLETOP BASKETBALL GAME

(76) Inventor: Leonard D. Bianco, 32 E. Hoover Ave., Phoenix, AZ (US) 85004

( * ) Notice: Subject to any disclaimer, the term of this patent is extended or adjusted under 35 U.S.C. 154(b) by 195 days.

(21) Appl. No.: 11/774,491

(22) Filed: Jul. 6, 2007

(65) Prior Publication Data

US 2009/0115135 A1 May 7, 2009

Related U.S. Application Data

(60) Provisional application No. 60/818,756, filed on Jul. 6, 2006.

(51) Int. Cl.
*A63F 7/06* (2006.01)

(52) U.S. Cl. ..... 273/317.3

(58) Field of Classification Search ..... 273/317, 273/317.1, 317.3, 236, 244, 259, 277, 287; D21/701, 703
See application file for complete search history.

(56) References Cited

U.S. PATENT DOCUMENTS

| | | | | | |
|---|---|---|---|---|---|
| 1,439,199 | A * | 12/1922 | Spilman | 273/317.3 |
| 2,261,448 | A * | 11/1941 | Petersen | 273/317.3 |
| 2,939,707 | A * | 6/1960 | Lemelson | 273/402 |
| 3,899,173 | A * | 8/1975 | Zaris | 273/317.3 |
| 4,210,328 | A * | 7/1980 | Meintzer et al. | 273/317.3 |
| 5,064,195 | A * | 11/1991 | McMahan et al. | 473/480 |
| 5,104,124 | A * | 4/1992 | Bernard et al. | 273/317.3 |
| 5,110,127 | A * | 5/1992 | Potter | 273/317.3 |
| 5,549,293 | A * | 8/1996 | Seifert | 273/317.3 |
| 7,159,867 | B2 * | 1/2007 | Huley | 273/259 |
| 7,472,801 | B1 * | 1/2009 | Moynihan et al. | 220/694 |
| 2004/0080108 | A1 * | 4/2004 | Huley | 273/243 |

* cited by examiner

*Primary Examiner*—Raleigh W. Chiu
(74) *Attorney, Agent, or Firm*—Snell & Wilmer L.L.P.

(57) ABSTRACT

A tabletop basketball game having a game board and miniature basketball and hoop to test a player's skills.

7 Claims, 9 Drawing Sheets

TABLETOP BASKETBALL GAME

CROSS-REFERENCE TO RELATED APPLICATIONS

This application claims priority to provisional patent application having Ser. No. 60/818,756, filed Jul. 6, 2006, which is herein incorporated in its entirety.

FIELD OF INVENTION

The present invention is generally directed to a tabletop basketball game and more particularly directed to an interactive tabletop basketball game having an arena (basketball court and seating), sound, lighting, timer, figurines, means for keeping score, and a miniature sized basketball hoop and balls for players to shoot baskets in order to score points during the game.

SUMMARY OF THE INVENTION

The product consists of three elements (games), a board game, a skill game requiring a miniature basketball to be bounced on a hard surface and aimed at an opening in a vertical surface slightly larger than the diameter of the miniature ball, and a half-court basketball arena with basket, small rigid balls covered with either hook or loop fastening material, and a backboard behind the basket consisting of alternating sections of hook and loop fastener material.

The board Game. A heavy cardstock board is imprinted with an image of a basketball court and a simulated arena seating area, which is divided into many sequential segments, surrounding the center court area. The playing board is imprinted on the inside surface of the cover of the game container. Objective of the game: Each player has a playing piece to move on the board. Players throw one or more dice to advance their playing piece around the segmented area outside the court. The segments on the board have positive and negative attributes, which may advance or retreat the players if they land on a particular segment. Points are also accrued along the way by landing on certain segments. The first player to accrue a given number of points is the winner, or the player who accrues the greatest number of points at the end of one circuit of the playing area is the winner. (A tally of the points earned is entered on a counter device that is used on all three games.)

The bounced ball skill game. A cardstock rectangular shaped box with a plastic face is mounted vertically on a hard surface (the half-court of the third game). The rectangular box is taller than it is wide and has a hole in the front face (the basket hole), located towards the upper half of the front face and slightly larger than the size of the miniature elastomer balls used in the game. The rectangular box also has an opening in the base of the front face to allow balls that have entered the hole in the box to be returned to the player for further play. Objective of the Game: Each player has a given time, or a given number of shots, at the basket hole by bouncing one ball at a time on the hard horizontal surface of the playing area, attempting to get the ball into the basket hole. A tally is kept of the number of balls that successfully enter the hole. Alternately, the player may choose to toss the ball at the basket hole to get it in. The winner is the player that scores the greatest number of "baskets" in a given length of time or a given number of shots.

The half-court skill game. A reinforced cardstock container, consisting of a five-sided base box (the half-court floor) and a five-sided cover box (the half-court ceiling), separated by four cylindrical columns inserted into the corner bracket pockets, form the basketball half-court floor and ceiling structure. The base and cover fit together forming the shipping container when the game is disassembled for storage. An additional vertical panel (the "backboard"), in a modified "U" shape, forms the backdrop with basket, backboard and arena audience images, and is secured between the base and cover. The backboard has a printed surface containing the image of an arena with a backboard surrounding a basket attached to the panel. The area immediately surrounding the backboard contains alternating segments of hook and loop material (Velcro). The game contains a total of ten balls, five each of spheres made of hard, but resilient material (hard rubber, wood or plastic) covered with either a hook or loop material. Two point counters are included to tally the scores achieved by each player. These are manually advanced three digit indicators, which are used with all three games. Objective of the game: Each player has a given length of time, or a given number of shots with a set of hook or loop balls to make baskets until no balls are returned for retry by the player. Achieving a basket is worth two points, getting the ball to stick to a corresponding hook or loop fastener on the backboard is worth one point. Balls that make it through the basket are collected below the basket, balls that do not stick rebound off the backboard and are returned to the player for another try.

BRIEF DESCRIPTION OF THE DRAWING FIGURES

FIG. 1 is a perspective view of the half-court skill game of the present invention which includes a half-court basketball arena with basket, small rigid balls covered with either hook or loop fastening material, and a backboard behind the basket consisting of alternating sections of hook and loop fastener material. The half-court basketball arena may also include one or more timers and a scoreboard.

Figure 1:
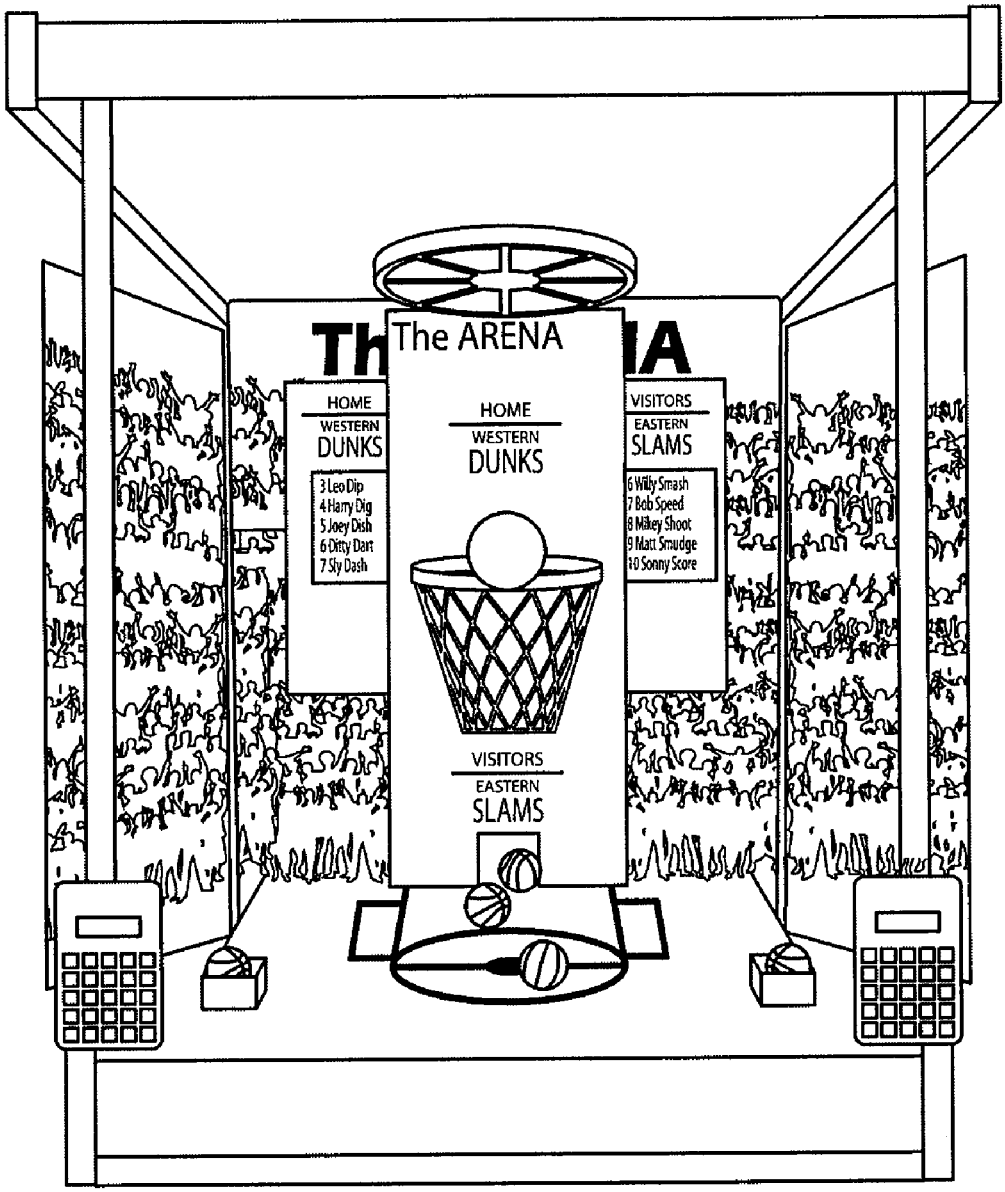
Figure 2:
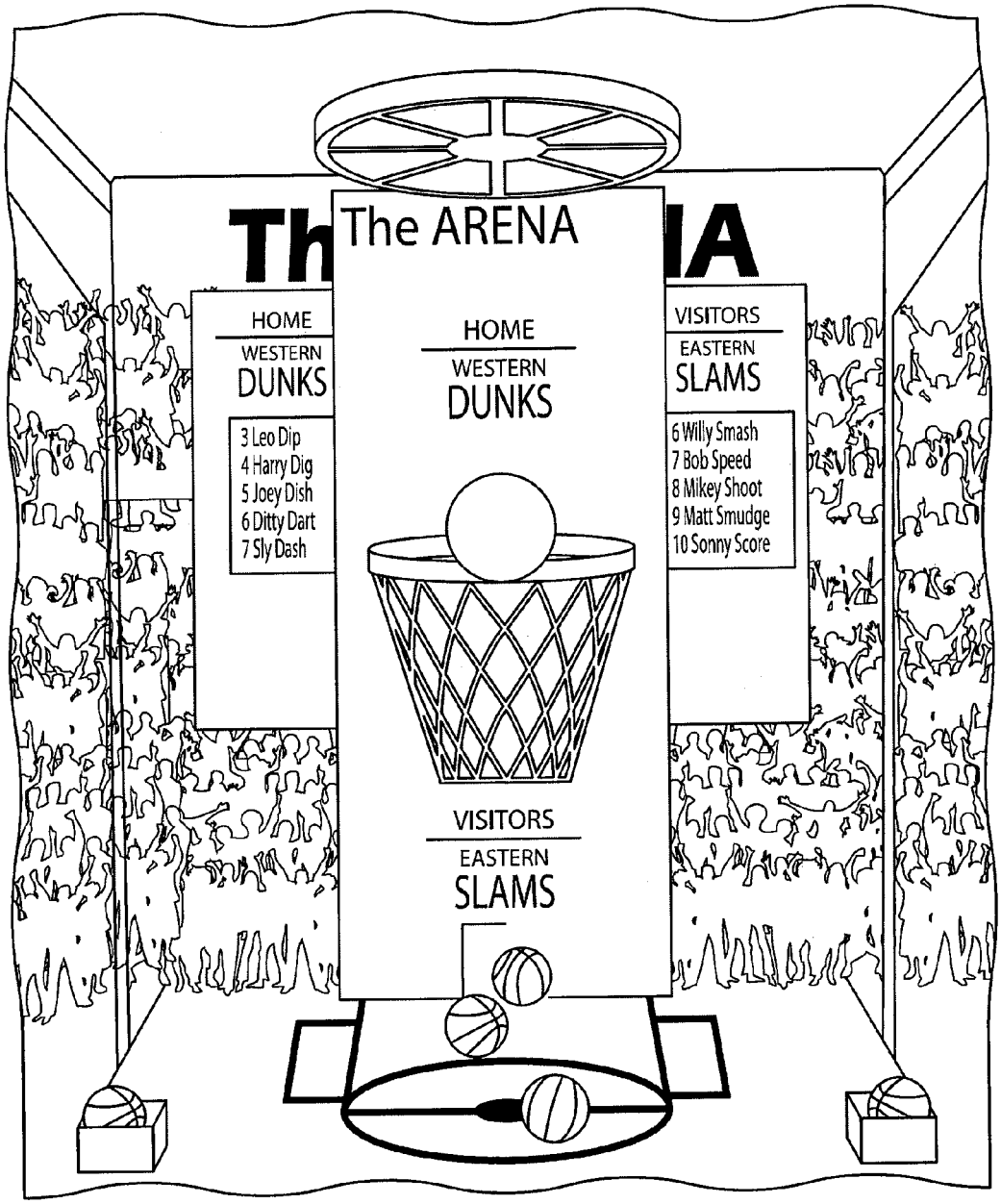
FIG. 2 is an enlarged perspective view of the half-court basketball skill game shown in FIG. 1.
Figure 3:
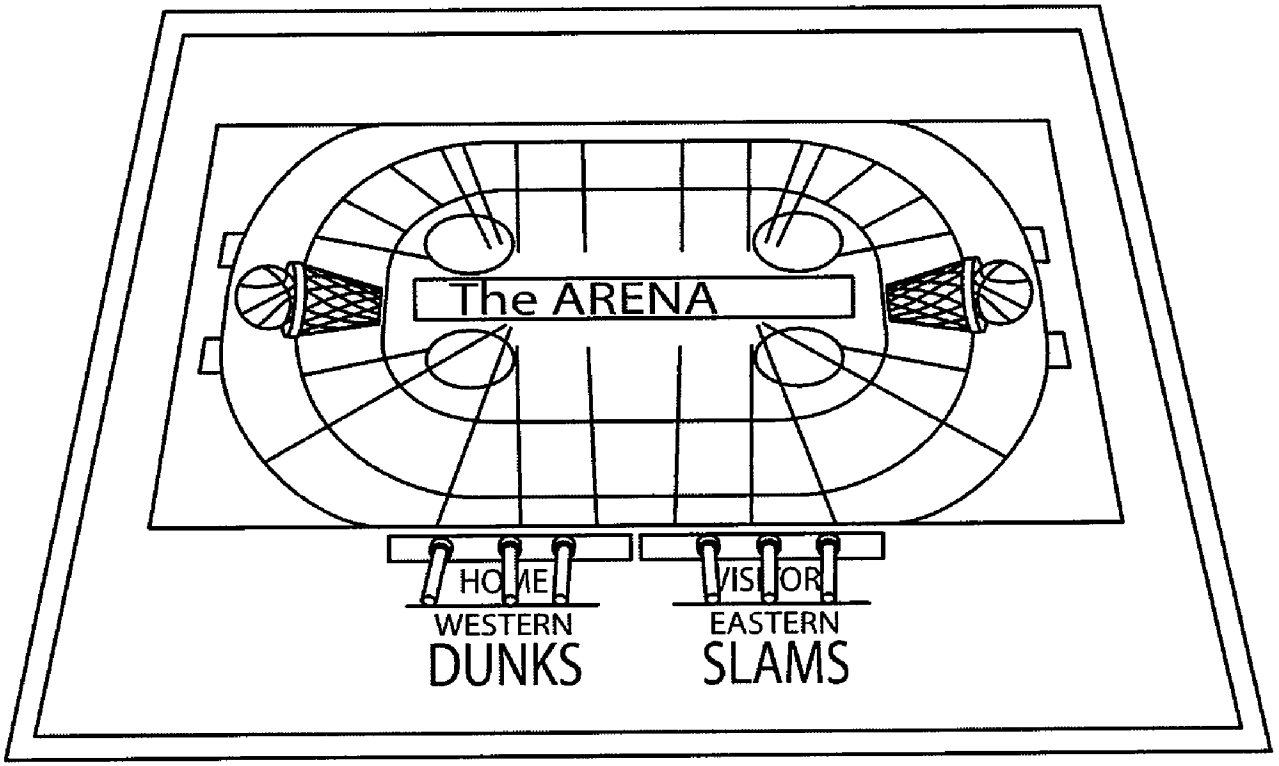
FIG. 3 is a perspective view of the board game portion of the present invention which includes a heavy cardstock board imprinted with an image of a basketball court and a simulated arena seating area which is divided into many sequential segments surrounding the center court area.
Figure 4:
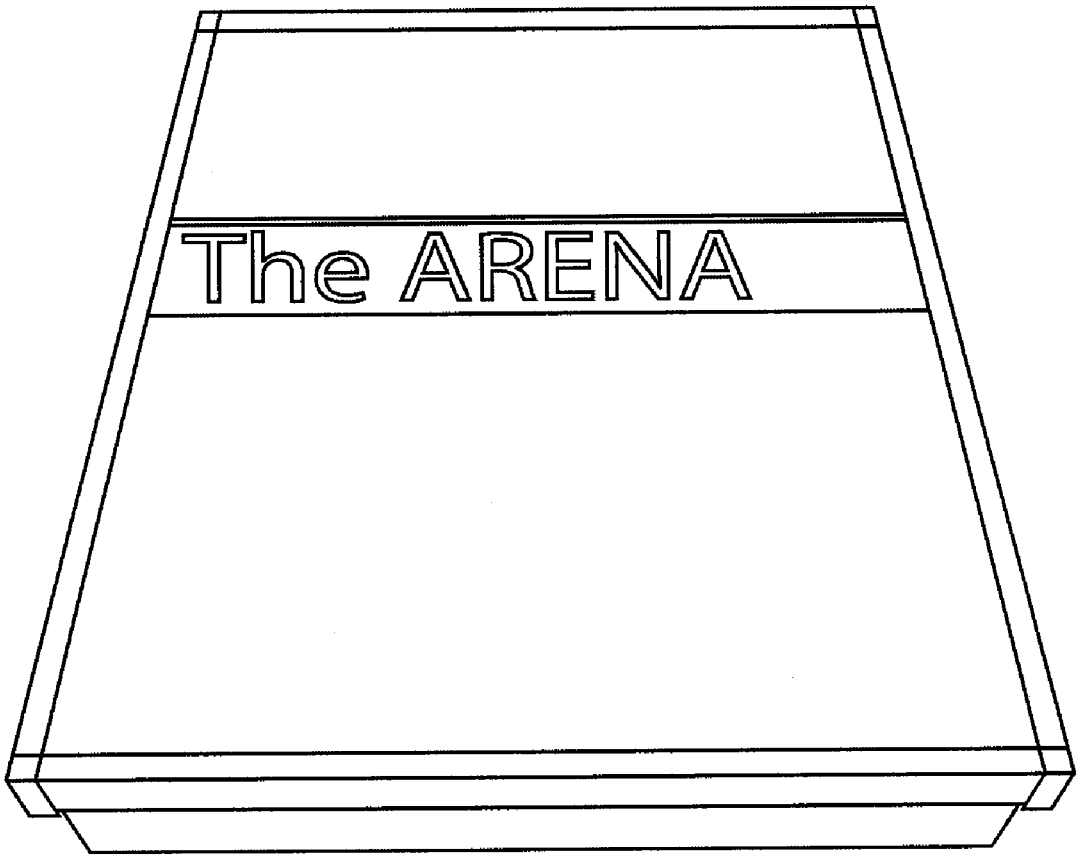
FIG. 4 is a perspective view of the outside of the rectangular box which comprises a tabletop basketball game of the present invention when it is stored and not in operation.
Figure 5:
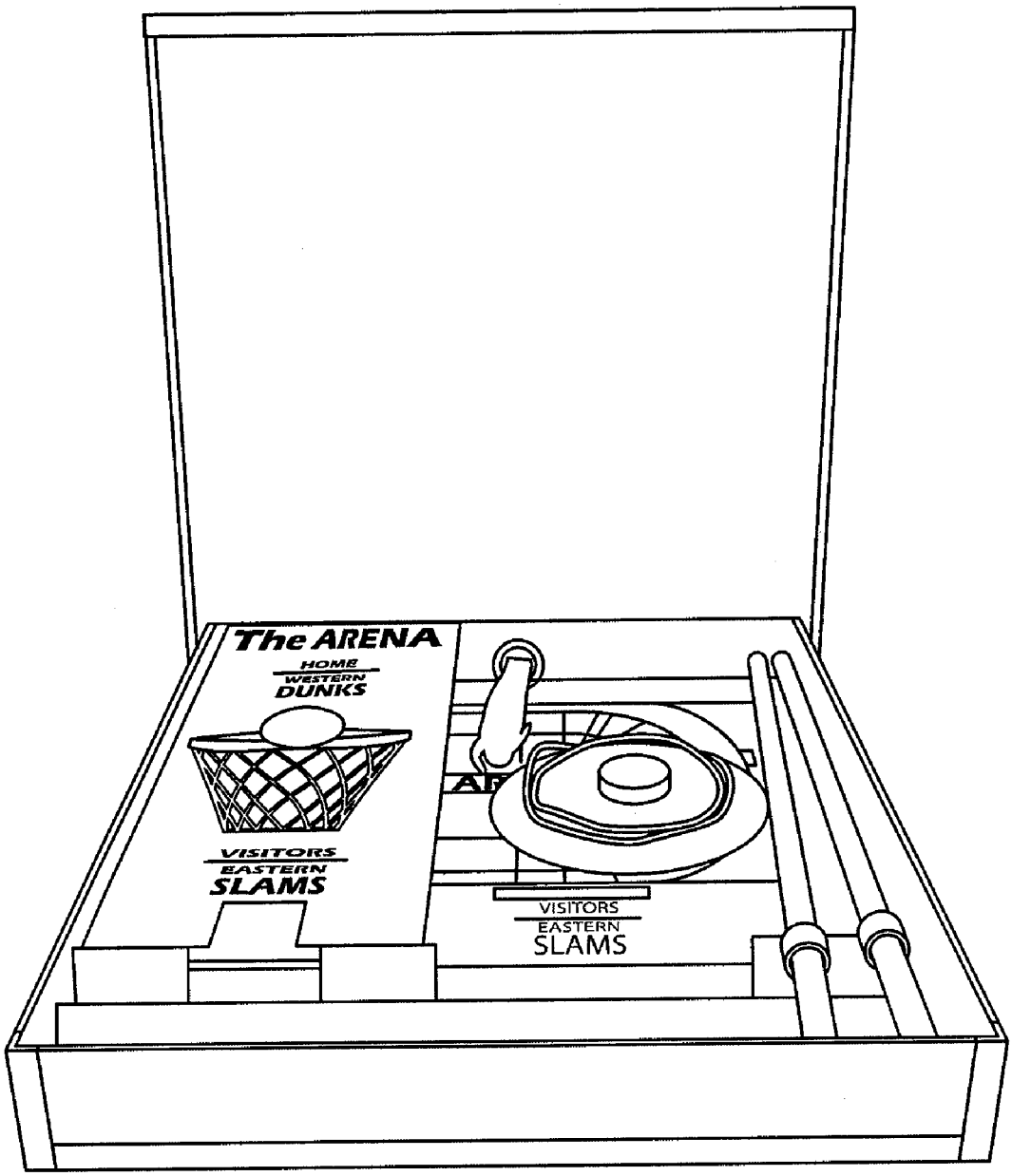
FIG. 5 is a perspective view of the tabletop basketball game of the present invention which shows the cover of the outside rectangular box shown in claim 4 lifted so that the components of the game are shown stored within the rectangular box which comprises the tabletop basketball game of the present invention.
Figure 6:
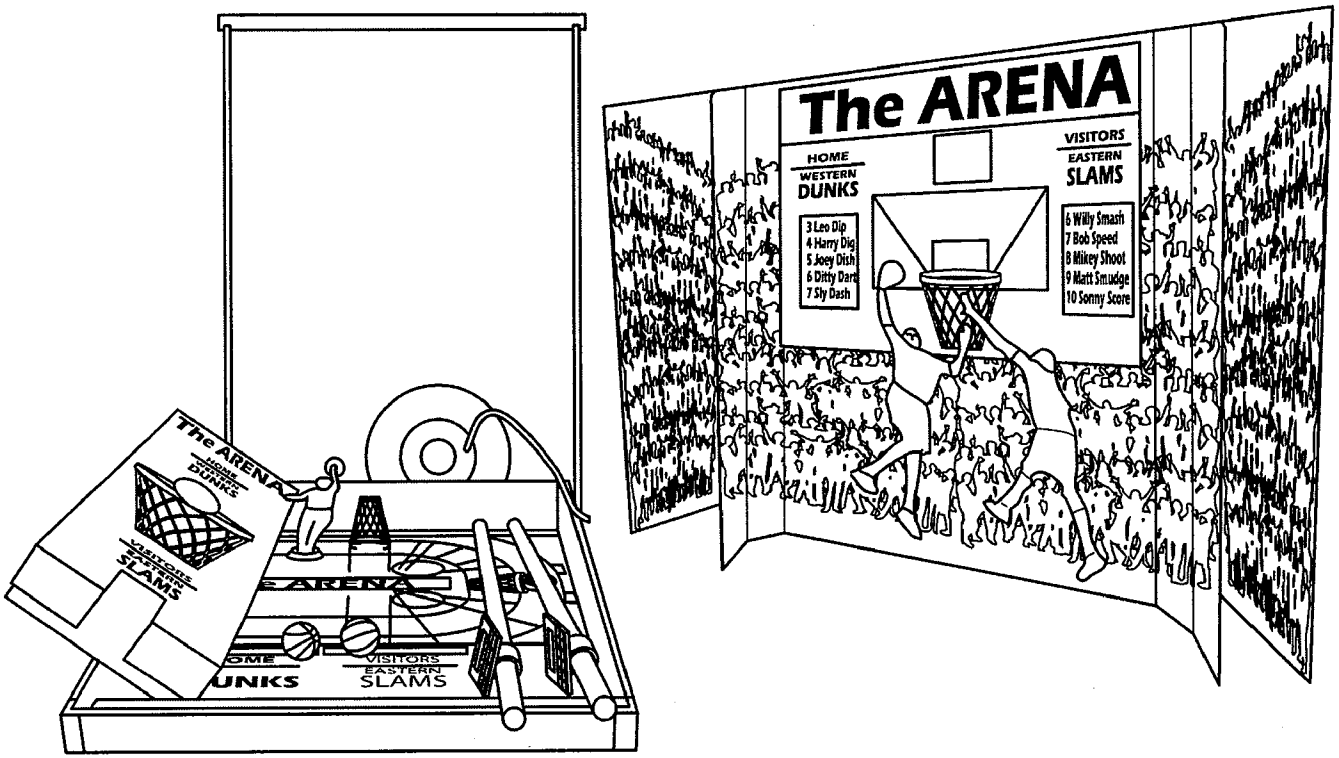
FIG. 6 shows the components of the tabletop basketball game of the present invention being removed from the rectangular box which stores them prior to their assembly.
Figure 7:
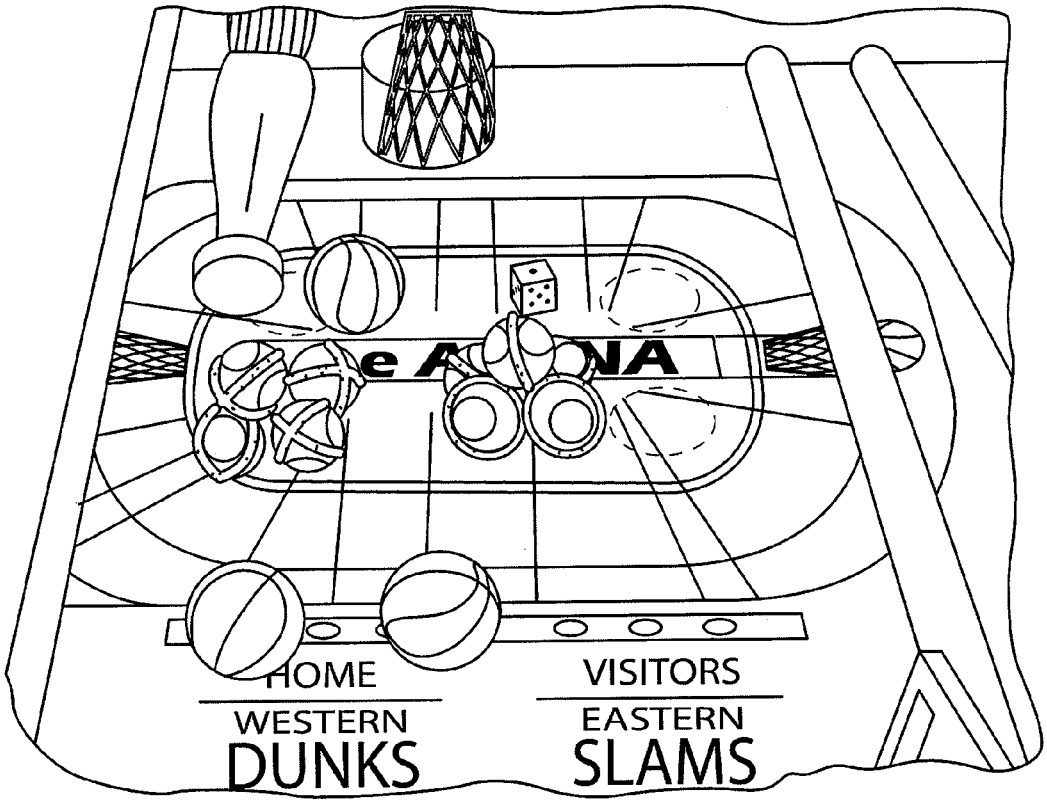
FIG. 7 illustrates an enlarged portion of the game components contained in the rectangular box shown in FIG. 6.
Figure 8:
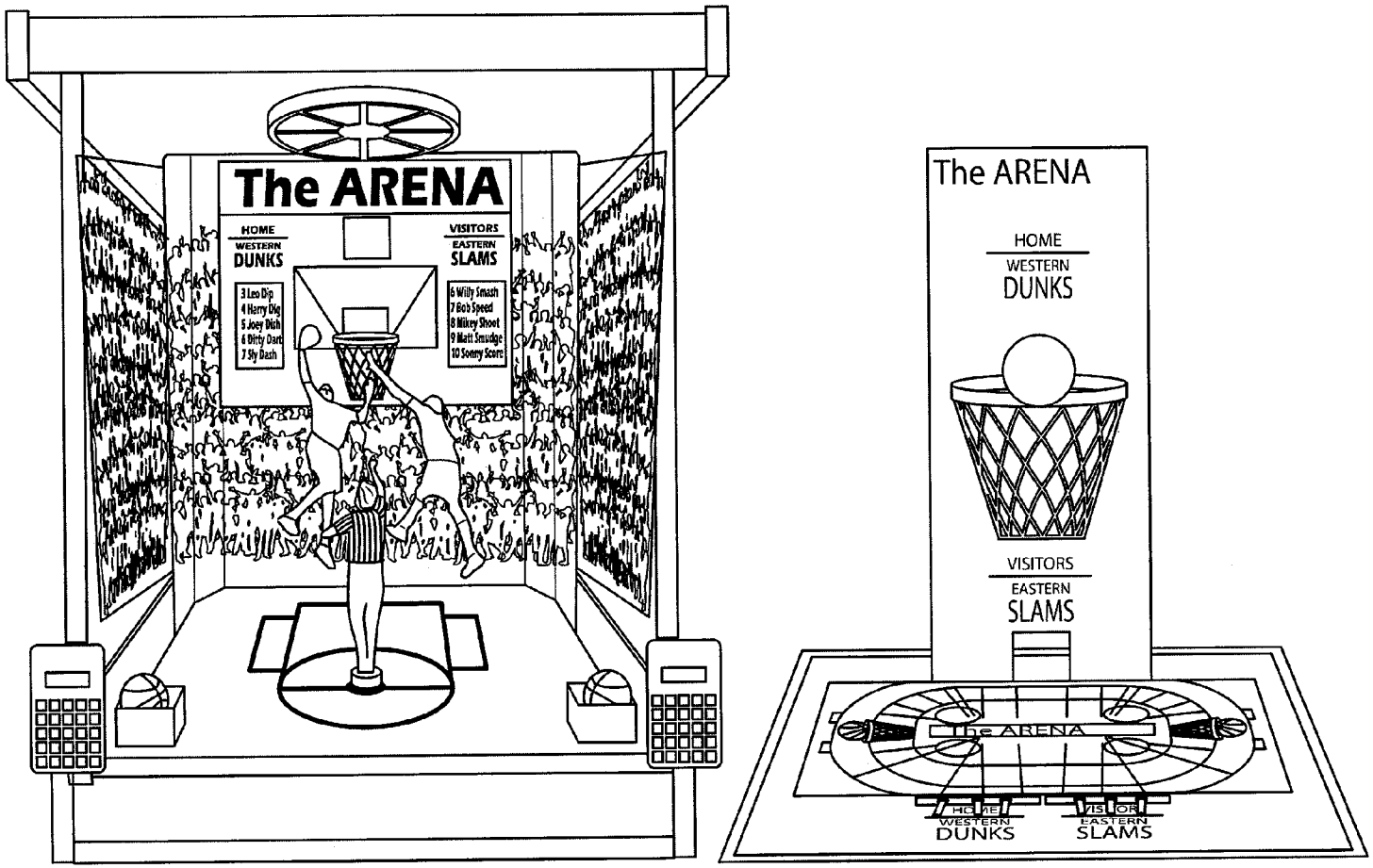

FIG. 8 shows both the half-court skill game for the described with reference to FIG. 1 and also shown in FIG. 6, the board game shown in FIG. 3, and the bounced ball skill game which includes a cardstock rectangular shaped box with a plastic face mounted vertically on a hard surface where the rectangular box has a hole in the front face located towards the upper half of the front face and an opening in the base of the front face to allow balls that have entered the hole in the box to be returned to a player.

Figure 9:
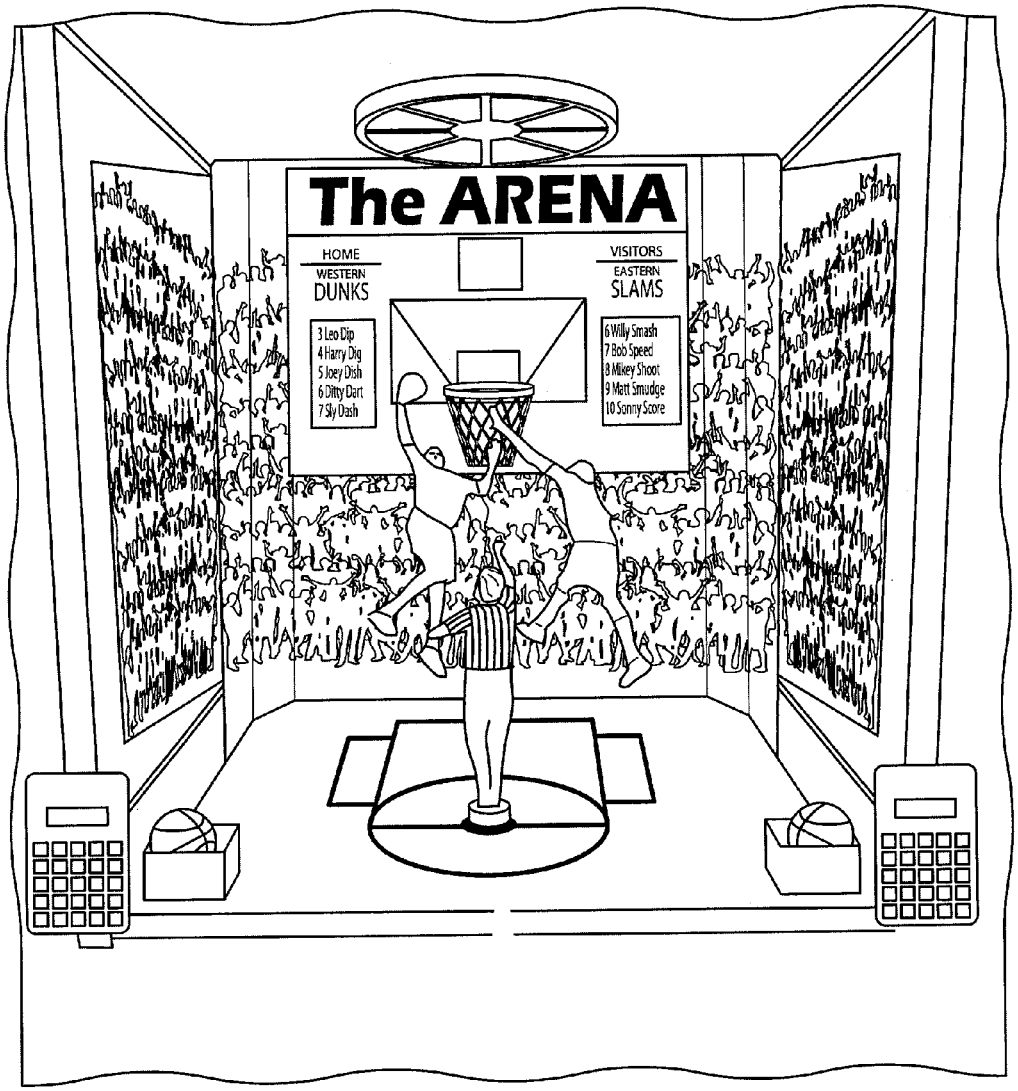

FIG. 9 in an enlarged portion of the half-court skill game of the tabletop basketball game of the present invention previously shown in FIG. 8.

The invention claimed is:

1. A tabletop basketball game comprising:

a game board;

a first rectangular box having at least one opening therein;

at least one ball that fits through said at least one opening;

a second box having a top half and a bottom half wherein the top half and the bottom half each have four corners and a corner support connected to each corner;

a plurality of cylindrical column members which fit inside the corner supports;

a vertical panel member having a miniature basketball hoop and basket attached thereto and a hook and loop material secured to the vertical panel member; and at least one ball having a hook and loop material contained on an outer surface of the ball.

2. The tabletop basketball game of claim 1 wherein the game board includes and image of a basketball court and arena seating area divided into multiple segments.

3. The tabletop basketball game of claim 2 further comprising a plurality of game pieces to move on top of the game board.

4. The tabletop basketball game of claim 3 further comprising a pair of dice.

5. The tabletop basketball game of claim 1 further comprising an audio component which simulates announcements and cheering that occur in a real basketball game.

6. The tabletop basketball game of claim 1 further comprising a lighting component for lighting at least a portion of the tabletop basketball game.

7. The tabletop basketball game of claim 1 further comprising at least one clock member for recording time.

* * * * *